US012295515B2

(12) United States Patent
Dougherty

(10) Patent No.: US 12,295,515 B2
(45) Date of Patent: May 13, 2025

(54) GARMENT WITH ACTUATABLE NECK PILLOW

(71) Applicant: Foamzy, LLC, Cincinnati, OH (US)

(72) Inventor: Mitchell Dougherty, Cincinnati, OH (US)

(73) Assignee: Foamzy, LLC, Cincinnati, OH (US)

( * ) Notice: Subject to any disclaimer, the term of this patent is extended or adjusted under 35 U.S.C. 154(b) by 0 days.

(21) Appl. No.: 18/115,370

(22) Filed: Feb. 28, 2023

(65) Prior Publication Data

US 2023/0276964 A1 Sep. 7, 2023

Related U.S. Application Data

(60) Provisional application No. 63/316,585, filed on Mar. 4, 2022.

(51) Int. Cl.
*A47G 9/10* (2006.01)
*A41D 3/02* (2006.01)

(52) U.S. Cl.
CPC ..... *A47G 9/1045* (2013.01); *A41D 3/02* (2013.01)

(58) Field of Classification Search
CPC ..... A41D 3/02; A41D 15/04; A41D 13/0512; A41D 13/0155; A47G 9/1045
See application file for complete search history.

(56) References Cited

U.S. PATENT DOCUMENTS 2,411,830 A * 11/1946 Krupp ..... A41D 13/0005 2/82
4,324,012 A * 4/1982 Cannaday ..... A47G 9/10 428/36.1
5,680,657 A * 10/1997 Valtakari ..... A41D 13/0158 2/455
6,564,387 B1 5/2003 Willoughby
D529,326 S 10/2006 Martin et al.
D553,302 S 10/2007 Wiens
7,412,728 B2 * 8/2008 Alesina ..... A41D 27/28 2/93
D653,487 S 2/2012 Blom et al.
D696,468 S 12/2013 Hartley
D781,615 S 3/2017 Parman
(Continued)

FOREIGN PATENT DOCUMENTS

CN 202843014 U 4/2013
CN 114340432 A 4/2022
WO 2020252542 A1 12/2020

*Primary Examiner* — Jameson D Collier
(74) *Attorney, Agent, or Firm* — Wood Herron & Evans LLP

(57) ABSTRACT

A garment includes a garment body, a pillow housing (including a pillow pad), and a drawstring assembly. The garment body is configured to enclose a torso of a wearer. The pillow housing is secured to the garment body. The pillow housing encloses a pillow pad. The pillow housing is convertible between an uncompressed and a compressed state. The drawstring assembly includes at least one drawstring extending around the pillow housing. A pull force exerted on the drawstring causes the pillow housing (and the pillow pad contained therein) to convert from the uncompressed to the compressed state. In the compressed state, the pillow housing and pillow pad form a cushion configured to provide support for a wearer's neck and head.

20 Claims, 16 Drawing Sheets

(56) References Cited

U.S. PATENT DOCUMENTS

| | | | | |
|---|---|---|---|---|
| D788,493 | S | 6/2017 | Parman | |
| 9,706,801 | B2 | 7/2017 | Hunkele | |
| D898,441 | S | 10/2020 | Bellot | |
| 10,791,775 | B2 | 10/2020 | Grogro et al. | |
| D917,789 | S | 4/2021 | Li et al. | |
| 2010/0043117 | A1 | 2/2010 | Hildebrandt | |
| 2013/0152270 | A1 | 6/2013 | Neal et al. | |
| 2017/0258154 | A1* | 9/2017 | Peyser | A45F 3/00 |
| 2017/0265554 | A1 | 9/2017 | Woodle | |
| 2019/0099021 | A1* | 4/2019 | Li | A47G 9/1081 |
| 2019/0274861 | A1* | 9/2019 | Gitomer | A41D 1/02 |
| 2020/0093195 | A1* | 3/2020 | Whitaker | A61F 9/045 |

* cited by examiner

GARMENT WITH ACTUATABLE NECK PILLOW

CROSS-REFERENCE TO RELATED APPLICATION

This application is related to and claims priority to U.S. Provisional Patent Application Ser. No. 63/316,585, filed on Mar. 4, 2022, the entire contents of which are herein incorporated by reference.

TECHNICAL FIELD

This application generally relates to garments, and more particularly, to a garment with integrated comfort features for use during travel, for example.

BACKGROUND

Traveling can be uncomfortable. For example, during a long-distance airplane flight or automobile journey, a passenger may be sequestered in a less-than-ergonomic seat for an extended period of time (e.g., several hours). To alleviate some discomfort, passengers may turn to comfortable garments designed for travel. However, existing travel garments exhibit various drawbacks or shortcomings. For example, some existing garments may require that parts of the garment be inflated to use integrated comfort features (e.g., an inflatable pillow) or may require that separate parts be independently stored and then selectively assembled together only when comfort features are desired (e.g., a pillow inserted into a hood). In presently-known designs, the garments may be more difficult to use or actuate than a wearer may want to tolerate, which means that increased comfort levels are not achieved as easily and as much as travelers desire.

Accordingly, it would be desirable to provide a garment that enhances comfort (particularly, when traveling) and avoids, alleviates, or otherwise minimizes the various drawbacks or shortcomings of existing travel garments.

SUMMARY

Certain exemplary aspects of the invention are set forth below. It should be understood that these aspects are presented merely to provide the reader with a brief summary of certain forms the invention might take and that these aspects are not intended to limit the scope of the invention.

In a first set of embodiments of the invention, a garment for selectively providing comfort features for a wearer of the garment is provided. The garment includes a garment body including a front panel and a back panel. The front panel and the back panel are connected to each other and configured to enclose a torso of a wearer. The garment further includes a pillow housing. A proximal end of the pillow housing is secured to the garment body at a shoulder region of the garment body. The pillow housing encloses a pillow pad within the pillow housing. The pillow housing is convertible between an uncompressed state and a compressed state. The garment also includes a drawstring assembly including at least one drawstring. The at least one drawstring extends around the pillow housing and is fixed at an end to the garment body at the shoulder region. A pull force exerted on a free end of the at least one drawstring causes the pillow housing, and the pillow pad contained therein, to convert from the uncompressed state to the compressed state. The pillow housing and pillow pad in the compressed state form a cushion at a neck region of the garment adjacent the shoulder region configured to provide support for a wearer's neck and head.

In one embodiment, the pillow housing includes a distal end opposite the proximal end. The distal end of the pillow housing may be unsecured from the garment body. In an uncompressed state, the distal end of the pillow housing may extend part way down the back panel of the garment. Additionally, the pillow housing may further include at least one housing channel extending along a surface of the pillow housing. The at least one drawstring may extend through the at least one housing channel. The at least one housing channel may prevent the at least one drawstring from directly contacting the pillow pad within the pillow housing. Further, the pillow housing may further include a pillow compartment therein. The pillow compartment may be configured to further secure the pillow pad within the pillow housing. Furthermore, the pillow housing may further include a closure zipper for securing the pillow pad within the pillow housing. The closure zipper may be located on a lateral side of the pillow housing.

In another embodiment, the back panel of the garment body may further include a back cushion configured to provide support for a wearer's back. The back cushion may be removably secured to the back panel by a pillow compartment. The garment body may further include at least one arm sleeve. The at least one arm sleeve may be connected at a proximal end to the garment body adjacent the shoulder region. The at least one arm sleeve may include a cuff at a distal end of the at least one arm sleeve. The distal end of the at least one arm sleeve opposite the proximal end of the at least one arm sleeve. Additionally, the garment body may further include a hood connected to the garment body at the shoulder region. Further, the garment body may further include a front pocket located on the front panel of the garment body. The front pocket may be a kangaroo pocket located near to a waist region of the garment body. Furthermore, the garment body may further include a waist cuff at a waist region of the garment body. Moreover, the front panel of the garment body may further include a closure zipper. The closure zipper may extend substantially vertically from the neck region to a waist region of the garment body.

In yet another embodiment, the garment body may further include at least one pant leg. The at least one pant leg may be connected at a proximal end to the garment body adjacent the waist region. The at least one pant leg may include a cuff at a distal end of the at least one pant leg. The distal end of the at least one pant leg opposite the proximal end of the at least one pant leg. Additionally, the at least one pant leg may include at least one leg cushion. The at least one leg cushion may be removably secured to the at least one pant leg by a pillow compartment. Further, the at least one leg cushion may include a first leg cushion and a second leg cushion. The first leg cushion may be located adjacent a waist region and may be configured to provide support for a wearer's posterior. The second leg cushion may be located between the first leg cushion and a distal end of the at least one pant leg and may be configured to provide support for a wearer's leg. The distal end of the at least one pant leg opposite the proximal end of the at least one pant leg.

In a further embodiment, the pillow pad may include compression features configured to facilitate the compression of the pillow pad when the pillow housing and pillow pad to convert from the uncompressed state to the compressed state. The compression features may be selected from a group consisting of apertures and grooves.

In another set of embodiments of the invention, a garment for selectively providing comfort features for a wearer of the garment is provided. The garment includes a garment body configured to enclose a torso of a wearer. The garment body includes two arm sleeves and a hood connected to the garment body. The garment body also includes a pillow housing secured to the garment body. The pillow housing encloses a pillow pad within the pillow housing. The pillow housing includes a closure zipper for securing the pillow pad within the pillow housing. The pillow housing also includes at least one housing channel extending along a surface of the pillow housing. The pillow housing is convertible between an uncompressed state and a compressed state. The garment body further includes a drawstring assembly including at least one drawstring. The at least one drawstring extending through the at least one housing channel. The at least one housing channel preventing the at least one drawstring from directly contacting the pillow pad within the pillow housing. A pull force exerted on a free end of the at least one drawstring causes the pillow housing, and the pillow pad contained therein, to convert from the uncompressed state to the compressed state. The pillow housing and pillow pad in the compressed state forming a cushion.

In yet another set of embodiments of the invention, a method for selectively providing comfort features for a wearer of a garment is provided. The method includes providing the garment. The garment includes a garment body configured to enclose a torso of a wearer. The garment also includes a pillow housing secured to the garment body. The pillow housing encloses a pillow pad within the pillow housing. The pillow housing, and the pillow pad contained therein, are convertible between an uncompressed state and a compressed state. The garment further includes a drawstring assembly including at least one drawstring extending around the pillow housing. The method also includes exerting a pull force on a free end of the at least one drawstring of the drawstring assembly. Exerting a pull force on the free end of the at least one drawstring causes the pillow housing, and the pillow pad contained therein, to convert from the uncompressed state to the compressed state. The pillow housing and pillow pad in the compressed state forming a cushion configured to provide support for a wearer's neck and head.

In one embodiment, the method may include securing the pillow housing and pillow pad in the compressed state using a fastener located on the at least one drawstring. The method may also include releasing the free end of the at least one drawstring. Releasing the free end of the at least one drawstring may cause the pillow housing, and the pillow pad contained therein, to convert from the compressed state to the uncompressed state.

BRIEF DESCRIPTION OF THE DRAWINGS

The accompanying drawings, which are incorporated in and constitute a part of this specification, illustrate embodiments of the invention and, together with the Detailed Description given below, serve to explain one or more embodiments of the invention.

DETAILED DESCRIPTION

The exemplary embodiments described herein are provided for illustrative purposes and are not limiting. Other exemplary embodiments are possible, and modifications may be made to the exemplary embodiments within the scope of the present disclosure. Therefore, this Detailed Description is not meant to limit the scope of the present disclosure.

Figure 14:
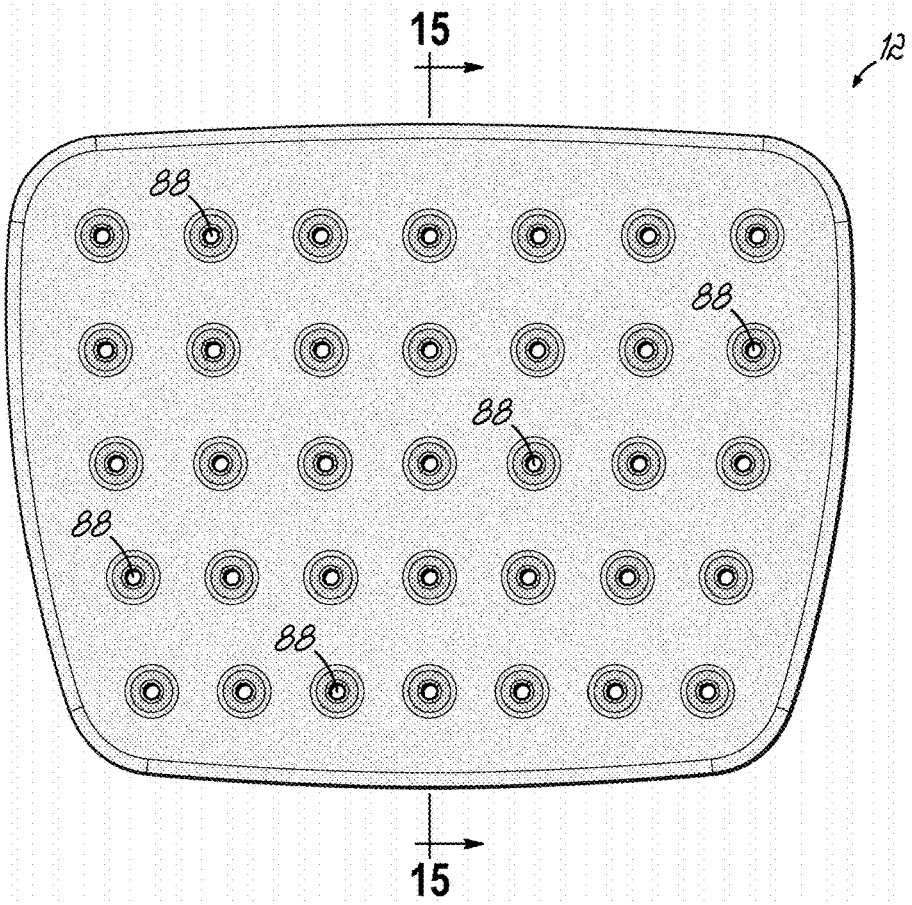
FIG. 14 is a front view of one embodiment of the pillow pad.
Figure 15:
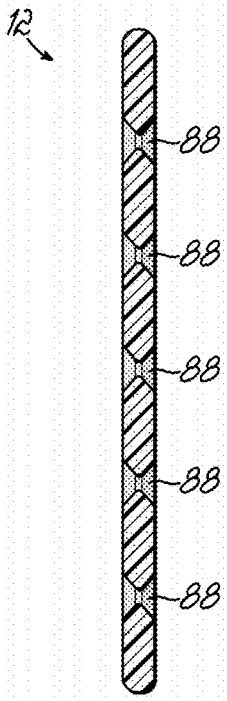
FIG. 15 is a cross-section of the pillow pad, taken along line 15-15 in FIG. 14.
Figure 16:
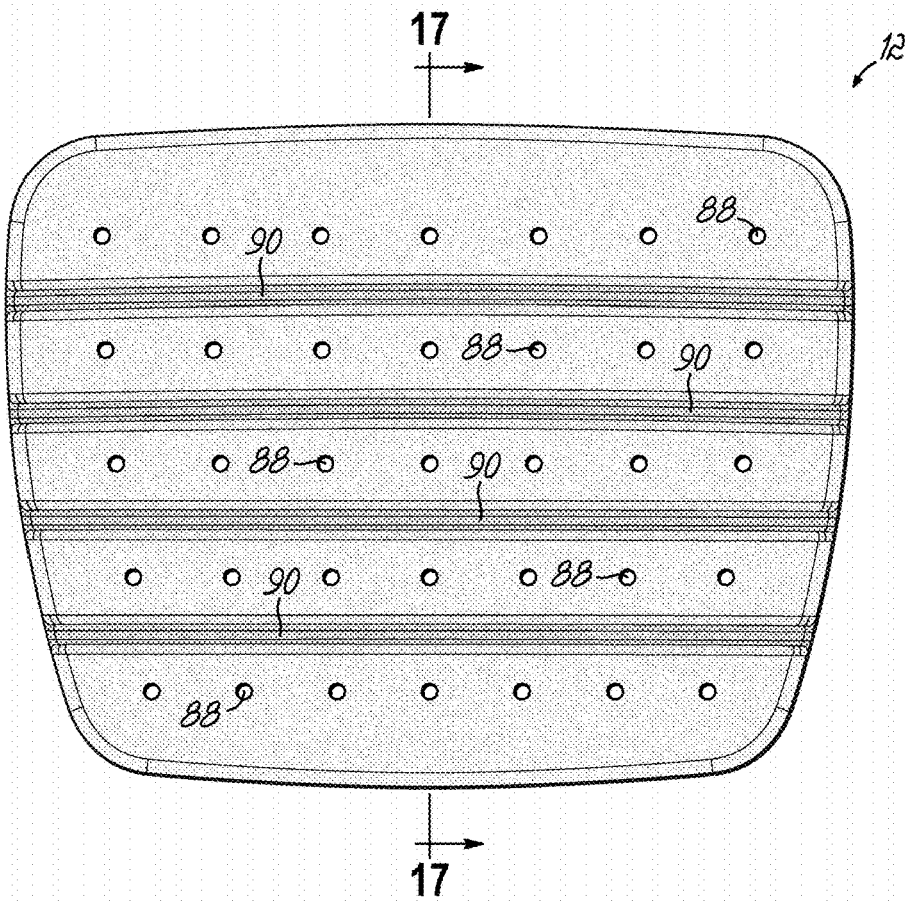
FIG. 16 is a front view of an alternative embodiment of the pillow pad.
Figure 17:
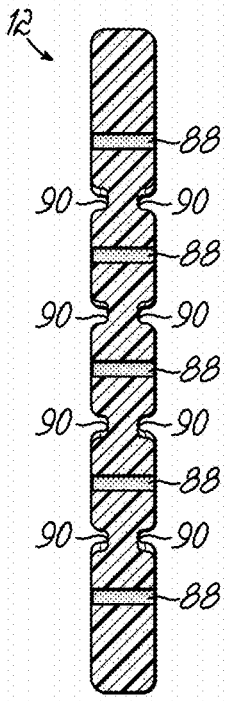
FIG. 17 is a cross-section of the pillow pad, taken along line 17-17 in FIG. 16.

With reference to FIGS. 1 through 17, a garment 10 with integrated comfort features and portions of such garment 10 are shown in detail. Advantageously, the garment 10 defines an item of travel clothing with an integrated, actuatable pillow pad 12. To this end, the pillow pad 12 can advantageously be actuated by a simple drawstring pull action between positions, one of which is a compressed position in which the pillow pad 12 folds or rolls into a neck pillow (or, alternatively, a cushion) for the wearer. In addition, the garment 10 also minimizes at least some of the drawbacks or shortcomings of existing travel garments. FIGS. 14 and 15 show an embodiment of a pillow pad 12 in detail. FIGS. 16 and 17 show an alternative embodiment of the pillow pad 12 in detail. Other advantages and technical effects of the embodiments of this invention will become evident to one skilled in the art from the following description.

Figure 1:
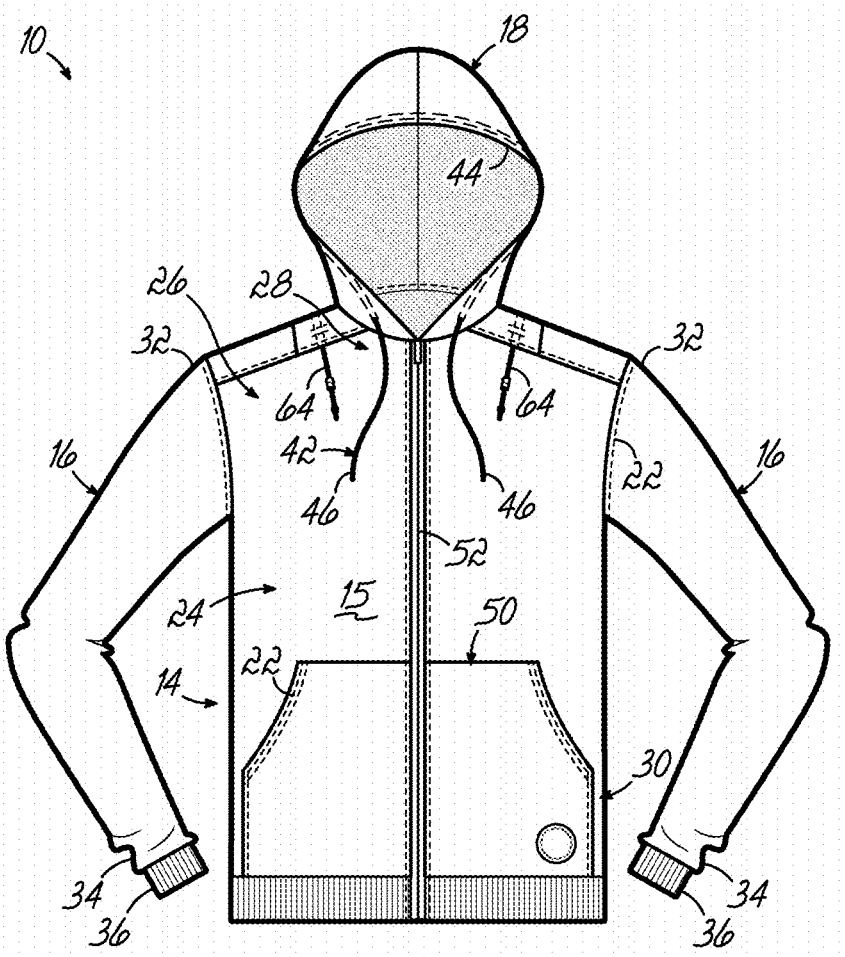
FIG. 1 is a front view of an embodiment of the garment.
Figure 2:
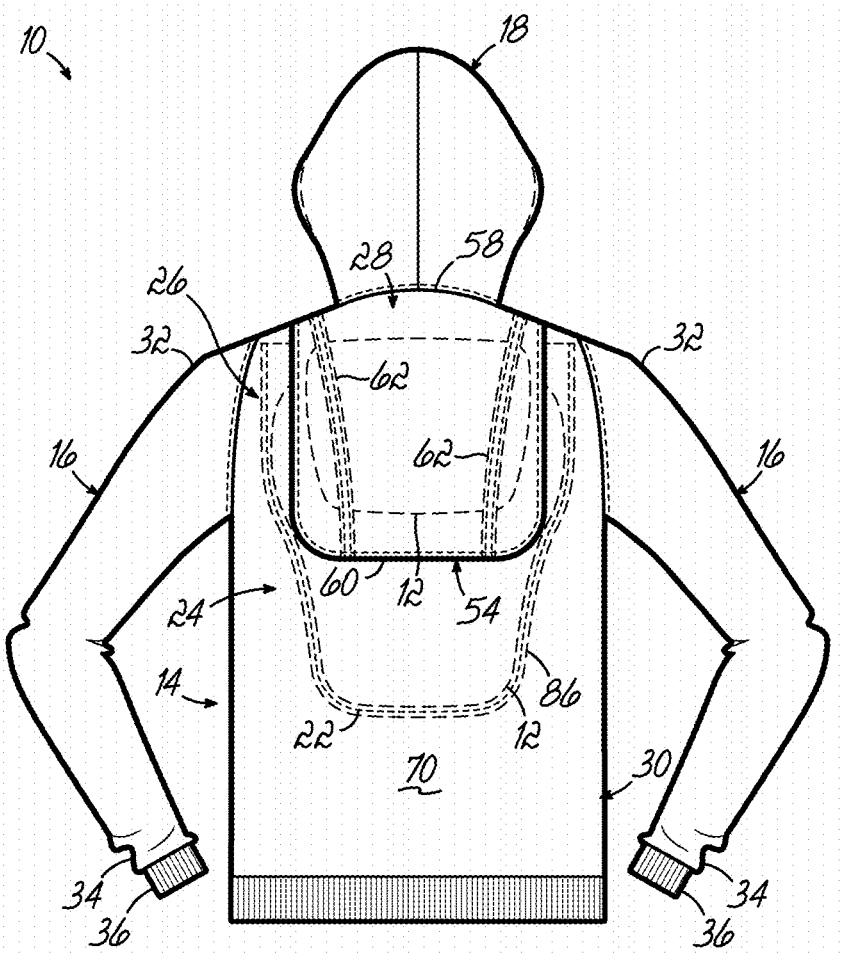
FIG. 2 is a rear view of the garment of FIG. 1.
Figure 3:
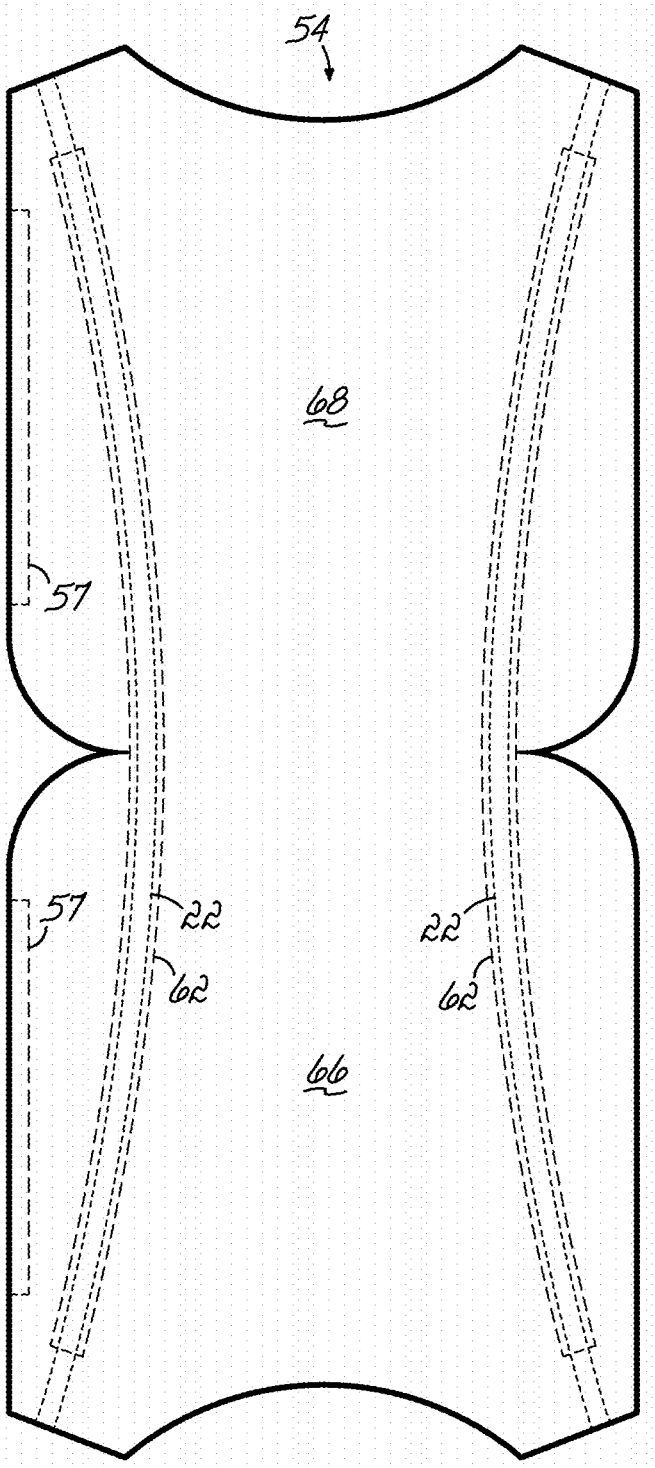
FIG. 3 is a top plan view of the pillow housing of the garment of FIG. 1.
Figure 4:
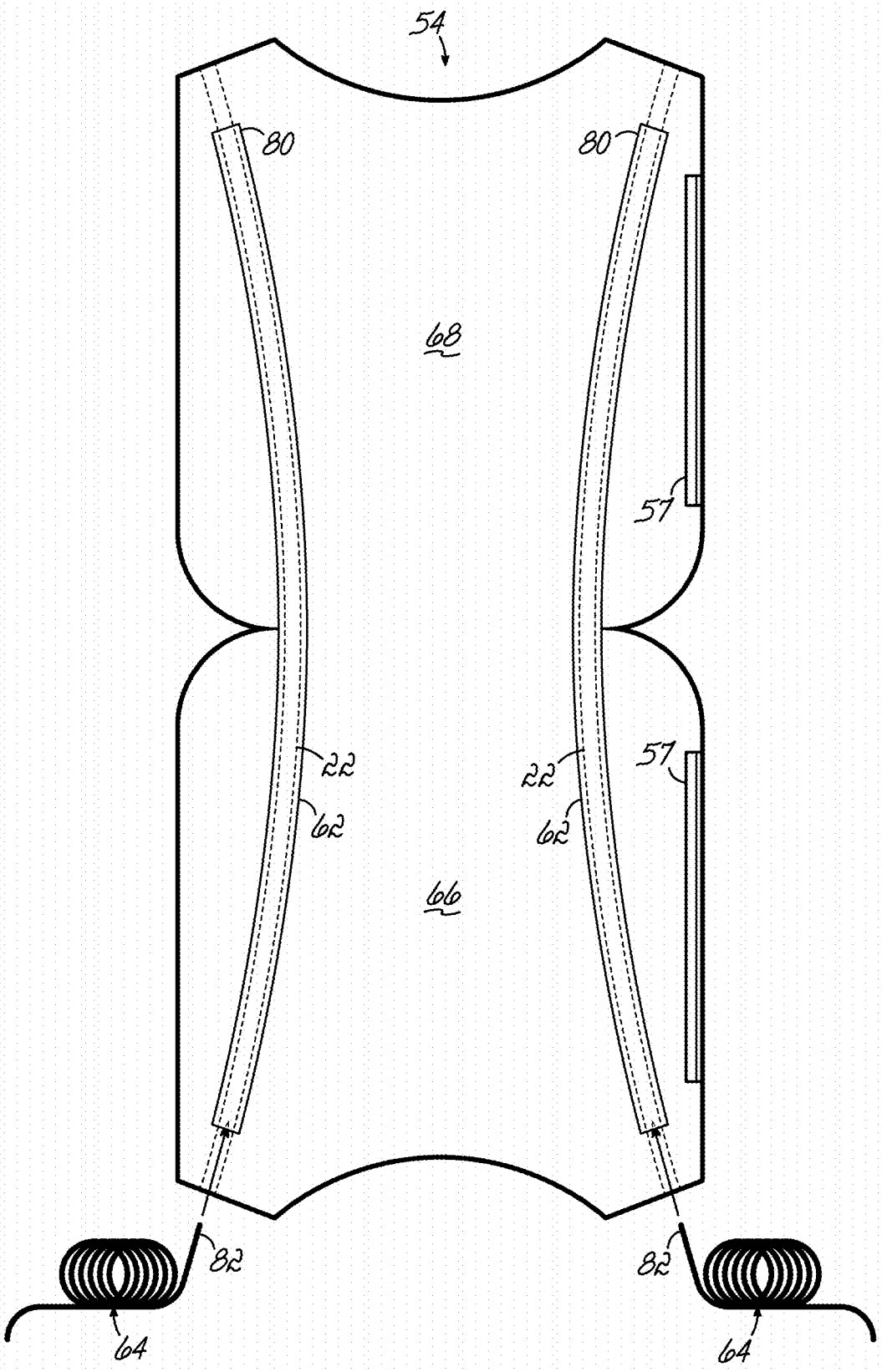
FIG. 4 is a bottom plan view of the pillow housing of the garment of FIG. 1.
Figure 5:
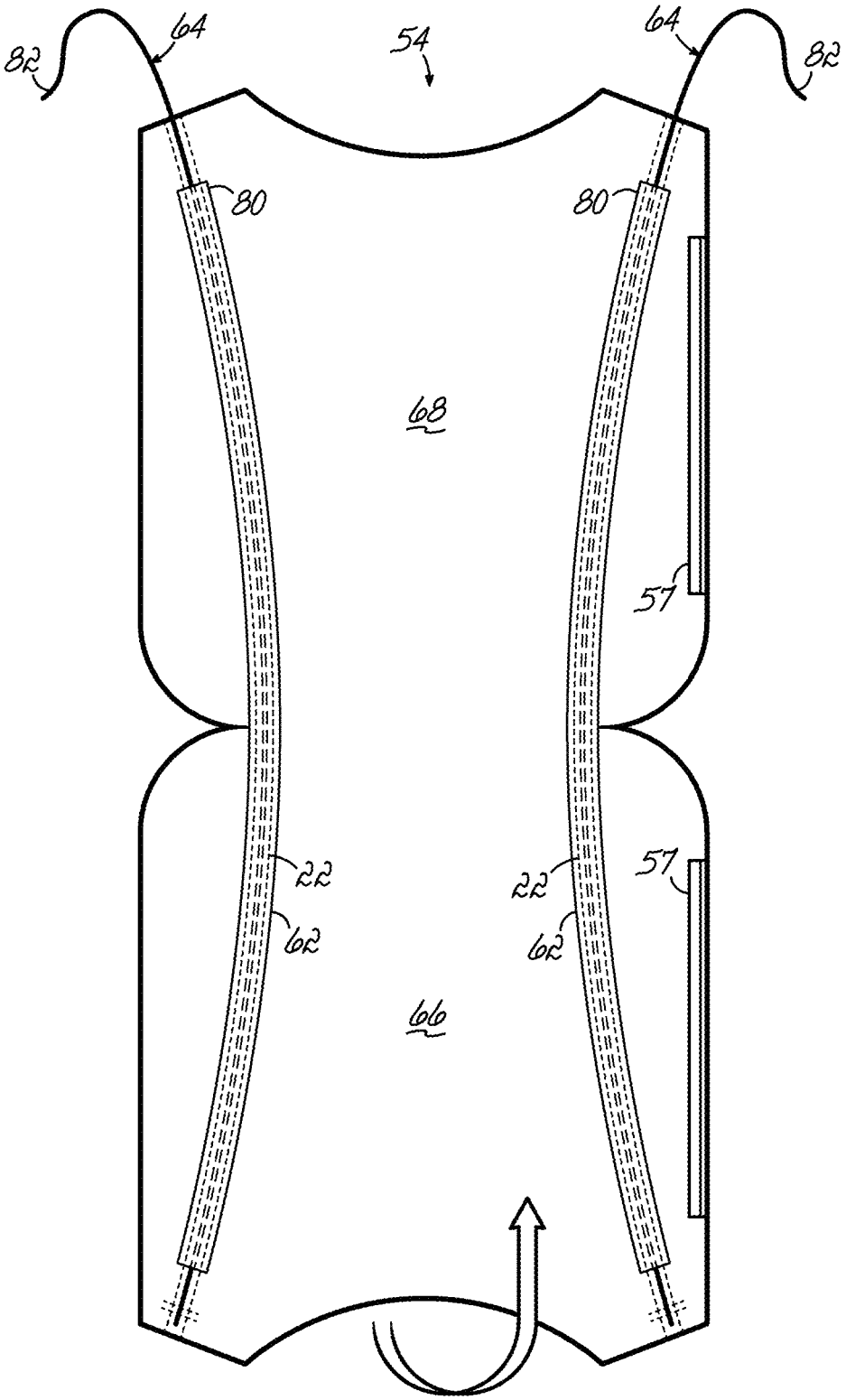
FIG. 5 is an additional bottom plan view of the pillow housing of the garment of FIG. 1.

Beginning with reference to FIGS. 1 and 2, the Figures depict an embodiment of the garment 10. As shown in this embodiment, the garment 10 is a one-piece item of clothing that, when worn, covers a portion of a wearer's body. In alternative embodiments, such as the embodiment shown in FIGS. 11-13 (described in greater detail below), the garment 10 may cover a majority of a wearer's body. The garment 10 is specifically intended to be worn while traveling, but it is to be understood that the garment 10 could also be worn in many other circumstances. For example, the garment 10 would be suitable for wear during any activity where further comfort may be desired such as gaming, studying (e.g., by a student), camping, attending a sporting event, attending a festival, or hunting. While some intended uses are expressly listed herein, it is contemplated that the garment 10 could be worn in other circumstances not expressly mentioned herein.

The garment 10 includes a garment body 14 defined by front and back panels 15, 70 that are connected and configured to enclose a wearer. The garment body 14 is flanked on opposing (e.g., left and right) sides by arm sleeves 16 connected to the garment body 14. The garment body 14 further includes a hood 18 connected to the garment body 14 at or near a top of the garment body 14. In alternative embodiments, such as the embodiment shown in FIGS. 11-13 (described in greater detail below), the garment 10 may include pant legs 20 connected to the garment body 14 at or near a bottom of the garment body 14. The arm sleeves 16, hood 18, and pant legs 20 are typically connected to the garment body 14 by stitching 22. In further alternative embodiments (e.g., than those expressly depicted and described herein), the garment 10 may include only some of the depicted parts. In the embodiment depicted in FIGS. 1 and 2, the garment 10 resembles a hooded sweatshirt form-factor and include the garment body 14, arms sleeves 16, and hood 18, but not the pant legs 20. The "hooded sweatshirt" embodiment of the garment 10 of this invention may be preferred (e.g., in comparison to the "onesie" embodiment depicted in FIGS. 11-13) by some wearers for adaptability and use in many settings including during travel.

Still referring to FIGS. 1 and 2, the garment body 14 includes a central torso region 24. The torso region 24 is arranged to be substantially aligned with the torso of a wearer. A shoulder region 26 of the garment body 14 is located above the torso region 24 of the garment 10. The shoulder region 26 is arranged to be substantially aligned with the shoulders of a wearer. The arm sleeves 16 are attached on opposing sides of the garment body 14 at or near the shoulder region 26. Located at or near the top of the garment body 14 and medially from the shoulder region 26 is a neck region 28. The neck region 28 is arranged to be substantially aligned with the neck of a wearer. The hood 18 is attached to the garment body 14 at or near the neck region 28. Below the torso region 24, the garment body 14 includes a waist region 30. The waist region 30 is arranged to be substantially aligned with the waist of a wearer. In the alternative embodiment depicted in FIGS. 11-13, the pant legs 20 are attached to the garment body 14 at or near the waist region 30.

A proximal end 32 of each arm sleeve 16 is attached to the garment body 14 at or near the shoulder region 26. The arm sleeves 16 extend away from the shoulder region 26 of the garment body 14 and terminate at distal ends 34. At the respective distal ends 34, each arm sleeve 16 includes a cuff 36. It is to be understood that alternative embodiments of the garment 10 may or may not include cuffs 36 at the end of arm sleeves 16. Further, it is to be understood that the arm sleeves 16 do not necessarily have to span the length of a wearer's arms (e.g., be long sleeved, as depicted). The arm sleeves 16 of various embodiments of the garment 10 may be shorter in length—for example, short sleeve length, elbow length, of three-quarters length.

With continued reference to FIGS. 1 and 2, the hood 18 is attached to the garment body 14 at a neck region 28 of the garment body 14. A drawstring 42 extends around a periphery 44 of the hood 18 and out from the hood 18. Ends 46 of the drawstring 42 may be pulled by a wearer to make an opening defined at a front of the hood 18 smaller. When not in use, ends 46 of the drawstring 42 rest against the garment body 14 of the garment 10. It is to be understood that alternative embodiments of the garment 10 may or may not include a hood 18.

The garment 10 may include a front pocket 50. The pocket 50 is arranged such that a wearer may comfortably insert their hands into the pocket 50 while wearing the garment 10. The pocket 50 may be two separate pockets (as depicted in FIG. 1, for example). It is to be understood that, in alternative embodiments, the pocket 50 may be alternatively arranged and/or located. For example, the pocket 50 may be what is known as a kangaroo pocket located on a midline of the garment 10 at or near the waist region 30. Alternatively, the pocket 50 could be located closer to the left and right edges, respectively, of the garment 10. Further, it is to be understood that alternative embodiments of the garment 10 may or may not include a pocket 50.

Still referring to FIGS. 1 and 2, to secure the garment 10 on a wearer, the depicted garment 10 features a closure zipper 52. The zipper 52 is located at or near a midline of the garment 10 and extends along the garment body 14 in a substantially vertical direction. In the depicted embodiment, the zipper 52 extends along the torso region 24 and through the waist region 30. It is to be understood that the zipper 52 could be alternatively located in an alternative embodiment. For example, the zipper 52 could be offset from the midline of the garment 10 (e.g., closer to a left or right edge of the garment 10) or located on a back of the garment 10. Further, the zipper 52 could extend a shorter or further length than is depicted. For example, in an alternative embodiment, the zipper 52 may only extend along the torso region 24 and terminate or before reaching the waist region 30. In further alternative embodiments, the zipper 52 may be omitted, e.g., where a wearer can pull the garment 10 over the body surfaces to be covered.

Referring specifically to FIG. 2, the Figure shows an additional pillow compartment 86 attached to the back panel 70 (e.g., by stitching 22) and located within an interior of the garment body 14. The construction of pillow compartment 86 is similar to the pillow compartment 86 described below with reference to FIG. 9A. An additional pillow 12 is located within the pillow compartment 86. The pillow 12 may be similar to the pillow 12 of the pillow housing 54, embodiments of which are described below with reference to FIGS. 14-17. The pillow compartment 86 spans roughly from the shoulder region 26 to a mid-back of the back panel 70. This additional pillow compartment 86 provides further comfort for a wearer. Particularly, the additional pillow 12 within the additional pillow compartment 86 provides additional support and cushion for a wearer's shoulders and back area.

Referring now to FIGS. 3-6, the Figures illustrate additional details of the pillow housing 54. Particularly, the Figures show that the pillow housing 54 includes housing channels 62 for the pillow housing drawstrings 64. The housing channels 62 extend along a first portion 66 of the pillow housing 54 and along a second portion 68 of the pillow housing 54 to form generally continuous housing channels 62 for the pillow housing drawstring 64. In the depicted embodiment, the housing channel 62 is located on an interior of the pillow housing 54. In an alternative embodiment, the housing channel 62 may be on the exterior of or integrated with the material of the pillow housing 54. In a preferred embodiment, the housing channels 62 separate the pillow housing drawstrings 64 from the pillow pad 12 such that the pillow housing drawstrings 64 do not come into direct contact with the pillow pad 12 within the pillow housing 54.

Further, the housing channels 62 cover the pillow housing drawstrings 64 such that the pillow housing drawstrings 64 are protected from exposure to the external environment outside the garment 10. The pillow housing drawstrings 64 extend through the housing channels 62 and along both the first and second portions 66, 68 of the pillow housing 54 such that the pillow housing drawstrings 64 effectively encircle a length of the pillow pad 12 when the pillow pad 12 is inserted into the pillow housing 54. More specifically, as shown in FIG. 9A, for example, the pillow housing drawstrings 64 continuously extend from a shoulder region 26 of the garment 10 along one side of the pillow housing 54 (at the first portion 66) towards a lower end 60 of the pillow housing 54, then wraps along the lower end 60 of the pillow housing 54, then extends along another side of the pillow housing 54 (at the second portion 68) towards the upper end 58 of the pillow housing 54, and returns to the shoulder region 26. This arrangement allows the pillow housing drawstrings 64 to selectively move the pillow pad 12 between its positions as described further herein, but favorably does not allow the pillow housing drawstrings 64 to become tangled or somehow stuck on the pillow pad 12 as it moves between those positions or with exterior elements outside the pillow housing 54. However, in an alternative embodiment, the pillow housing drawstrings 64 or portions thereof may contact the pillow pad 12 within the pillow housing 54 and/or the pillow housing drawstrings 64 or portions thereof may be exposed or partially exposed to the environment.

Figure 6:
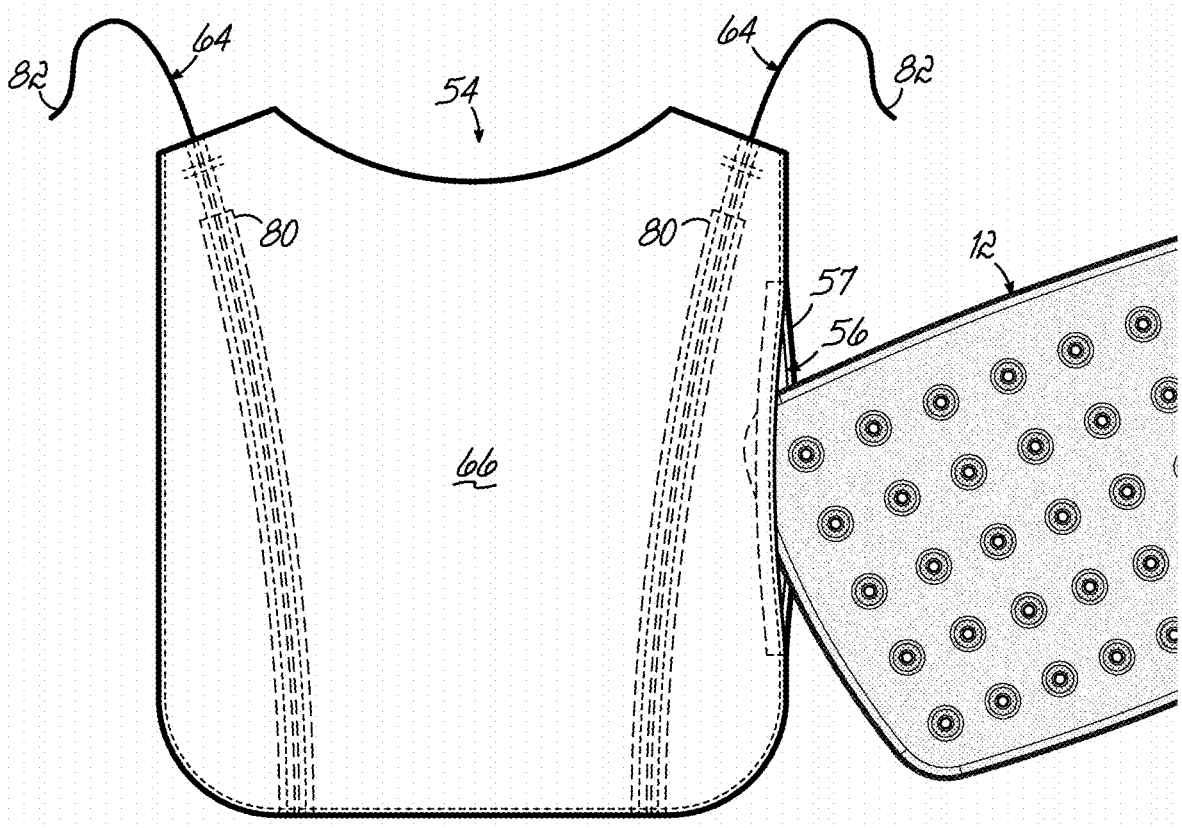
FIG. 6 is a detail view of the pillow housing of the garment of FIG. 1, showing the pillow pad being inserted into the pillow housing.

Referring specifically to FIG. 6, the Figure shows further details of the pillow housing 54. In the depicted embodiment, the opening 56 through which the pillow pad 12 can be inserted into the pillow housing 54 is located on a lateral side of the pillow housing 54. The opening 56 features a closure element 57 that permits the opening 56 to be fastened closed to protect the contents of the pillow housing 54 (e.g., the pillow pad 12) from the environment. In the depicted embodiment, the closure element 57 is a hidden closure zipper. It is to be understood that in alternative embodiments, the closure element 57 could be a mechanical fastener (or fasteners) other than a closure zipper. For example, the closure element 57 could be one or a series of hook-and-loop fasteners, snap fasteners, buttons, or similar. Further, in an alternative embodiment, the pillow housing 54 may include a cover (not shown). The cover could enclose the opening 56 of the pillow housing 54 to provide additional protection to the contents of the pillow housing 54 (e.g., the pillow pad 12) from the environment.

Figure 7:
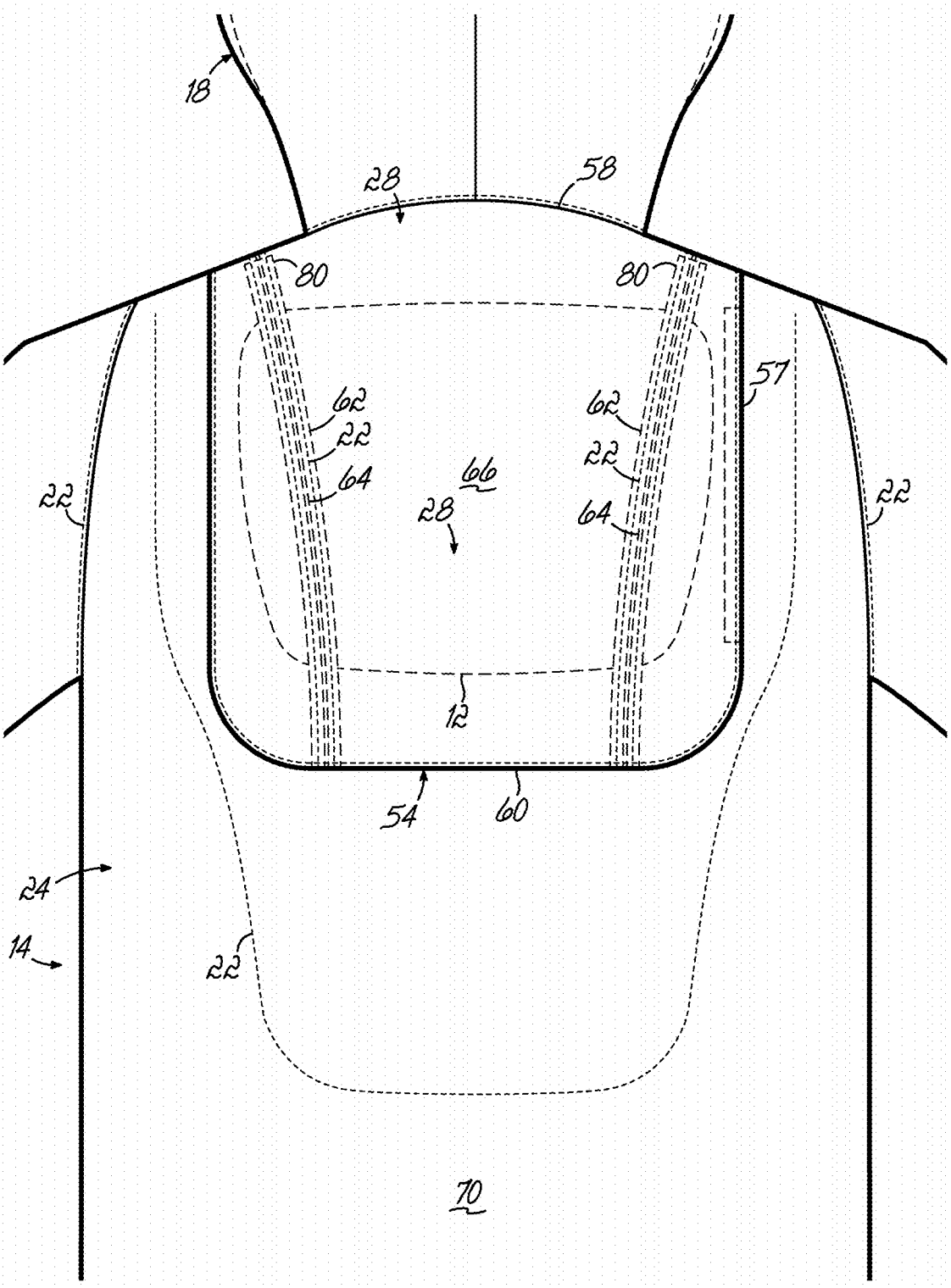
FIG. 7 is a rear detail view of the garment of FIG. 1.
Figure 8:
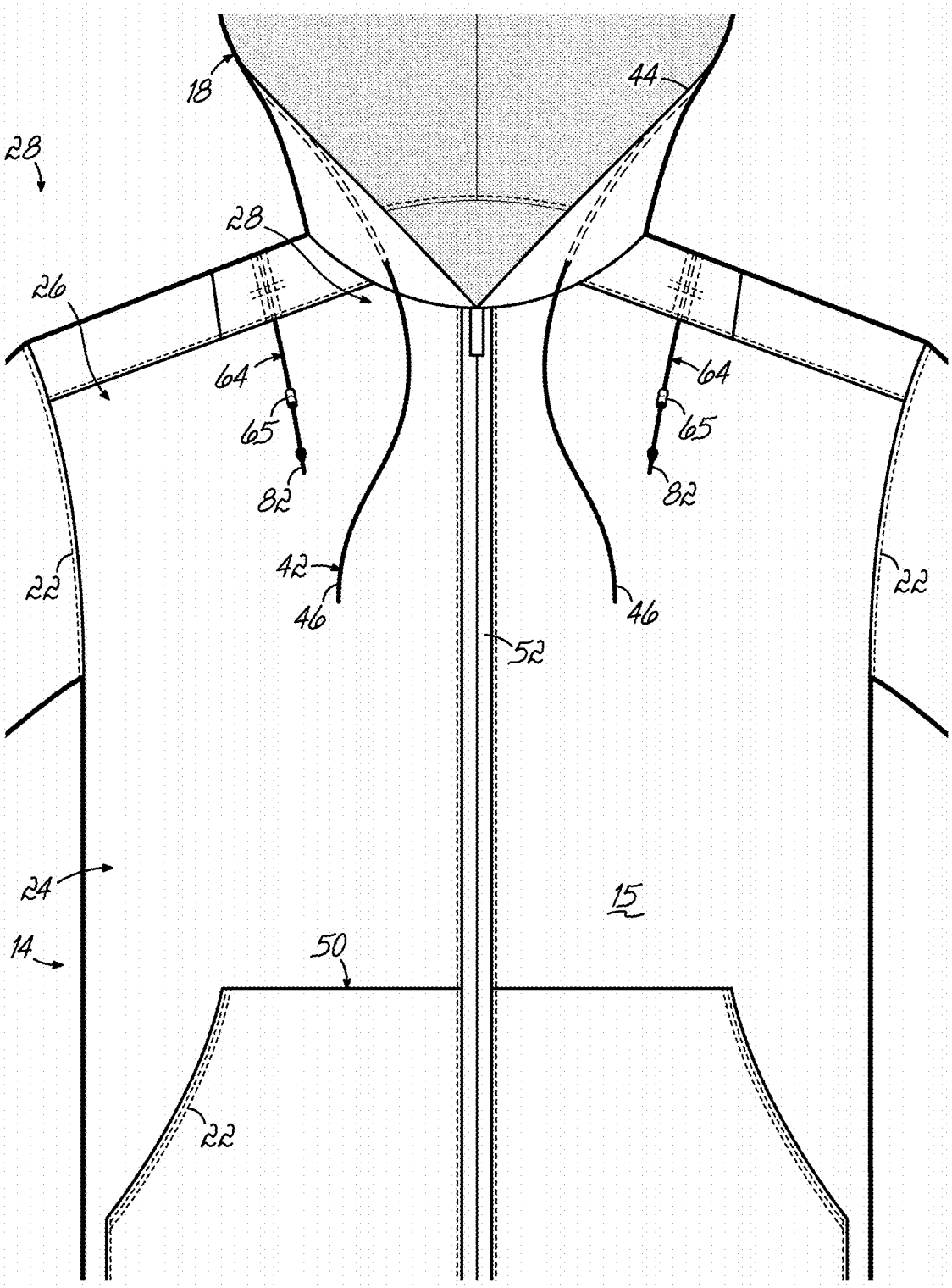
FIG. 8 is a front detail view of the garment of FIG. 1.

Referring now to FIGS. 7 and 8, these Figures depicts the garment body 14 in greater detail. Particularly, FIG. 7 shows the pillow housing 54 in detail and attached to the garment body 14. As shown, the pillow housing 54 contains a pillow pad 12 therein. In one embodiment, shown in FIGS. 2 and 7, for example, the pillow pad 12 extends continuously across a central portion of the pillow housing 54 within the pillow housing 54. The pillow housing 54 is operatively connected at an upper end 58 of the pillow housing 54 to the garment 10 at or near the shoulder region 26 and/or the neck region 28 of the garment 10. In the depicted embodiment, the pillow housing 54 is attached along the entire upper end 58 of the pillow housing 54 to the garment 10 by stitching 22. It is to be understood that the upper end 58 of the pillow housing 54 could be connected in alternative ways to the garment 10, including in removable manners. For example, connection by hook-and-loop fastener, snap fastener, button, or similar may be used. Further, as depicted in FIG. 7, the pillow housing 54 is less wide than the width of the shoulders of the garment 10. It is to be understood that the pillow housing 54 could be more or less wide as desired for a particular use case. For example, the pillow housing 54 could be approximately commensurate in width with the width of the shoulders of the garment 10.

Preferably, the pillow housing 54 in the depicted embodiment is attached to the garment 10 at only one location (e.g., along the shoulder and/or neck region 26, 28). A lower end 60 of the pillow housing 54 as well as a remainder of the pillow housing 54 between the ends 58, 60 remains unsecured from the remainder of the garment 10. As a result, the wearer advantageously does not need to disconnect portions of the pillow housing 54 from a back side of the garment 10, which may not be easily accessible during travel, in order to allow for actuation and use of the comfort features described further below. However, it is to be understood that the pillow housing 54 could be attached or removably attached to the garment 10 at additional locations on the back panel 70.

With continued reference to FIG. 7, the pillow housing 54 extends part way (e.g., approximately halfway) down and rests against a back panel 70 of the garment 10 such that the lower end 60 of the pillow housing 54 rests approximately at the midback of a wearer. Described another way, as shown in FIGS. 2 and 7, for example, the lower end 60 of the pillow housing 54 terminates approximately halfway down the back panel 70 of the garment body 14. A lower end of the back panel 70 at least partially defines a lowermost end of the garment body 14. To this end, the pillow housing 54 preferably does not extend through the torso region 24 to be located at or near the waist region 30, which is advantageous because the pillow housing 54 and its pillow pad 12 then do not become another cumbersome layer that needs to be carefully managed by the wearer while wearing the garment 10 in various settings. More particularly, the pillow housing 54 of this general size has been found to stay in the desired position during garment use without necessitating additional connection or retention measures to be used, which means that the pillow pad 12 is always positioned properly for use as desired while also not getting in the way of the wearer. In this regard, the pillow housing 54 and the pillow pad 12 are not so large as to accidentally be folded or bunched up in a manner that would be uncomfortable to the wearer, nor does the pillow pad 12 in this configuration block a wearer from easy access to parts of their back that may need to be reached for scratching an itch, or for being heated/cooled in seats with integrated heaters or air conditioning. It is to be understood that, in alternative embodiments, the pillow housing 54 (and the pillow pad 12 therein) could be slightly longer or shorter than is depicted, but still terminate at or near the midback area for the reasons set forth herein.

Figure 9:
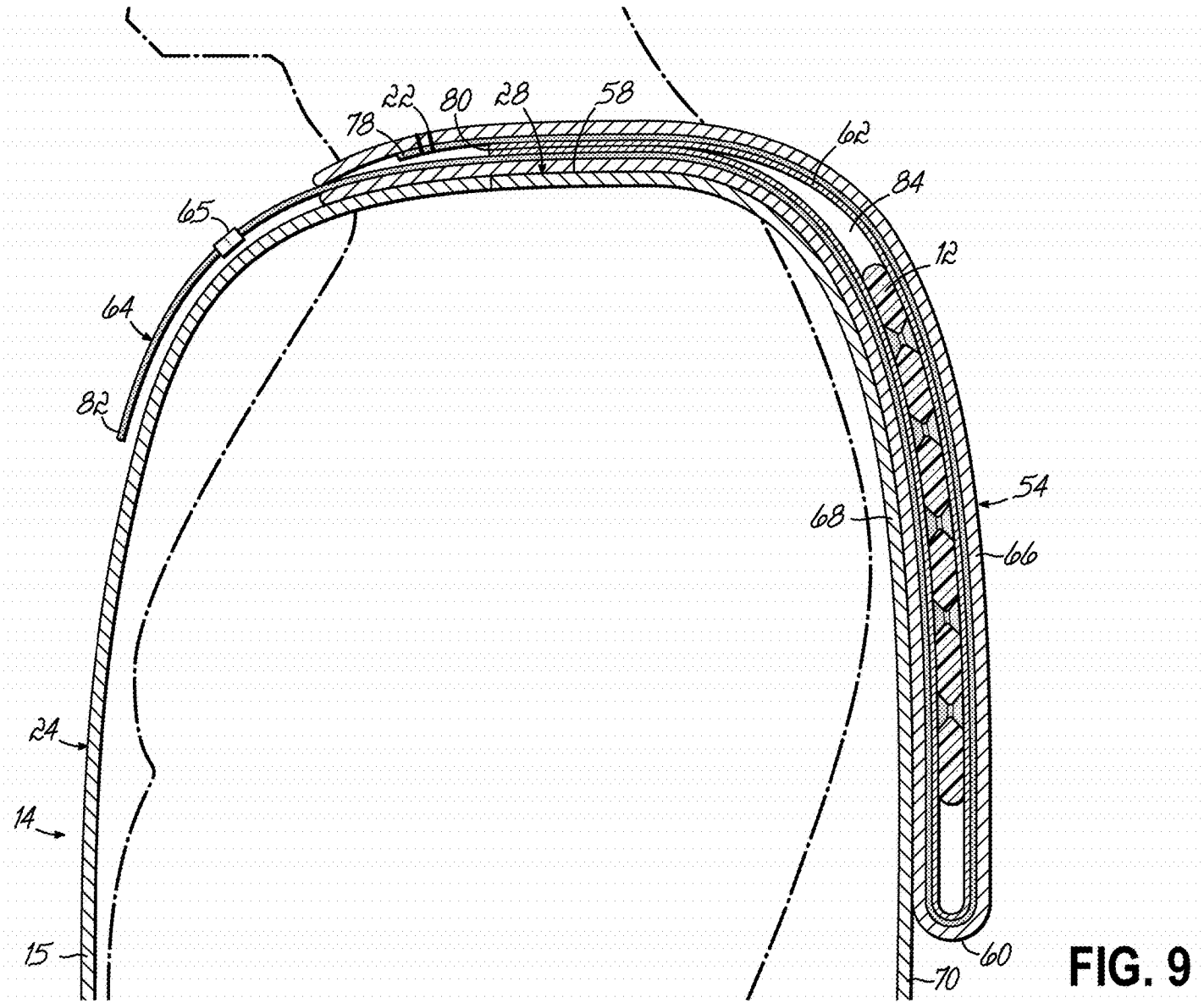
FIG. 9 is a partial cross-section of the garment of FIG. 1, showing the pillow housing and the pillow pad contained therein in an uncompressed state.
Figure 9A:
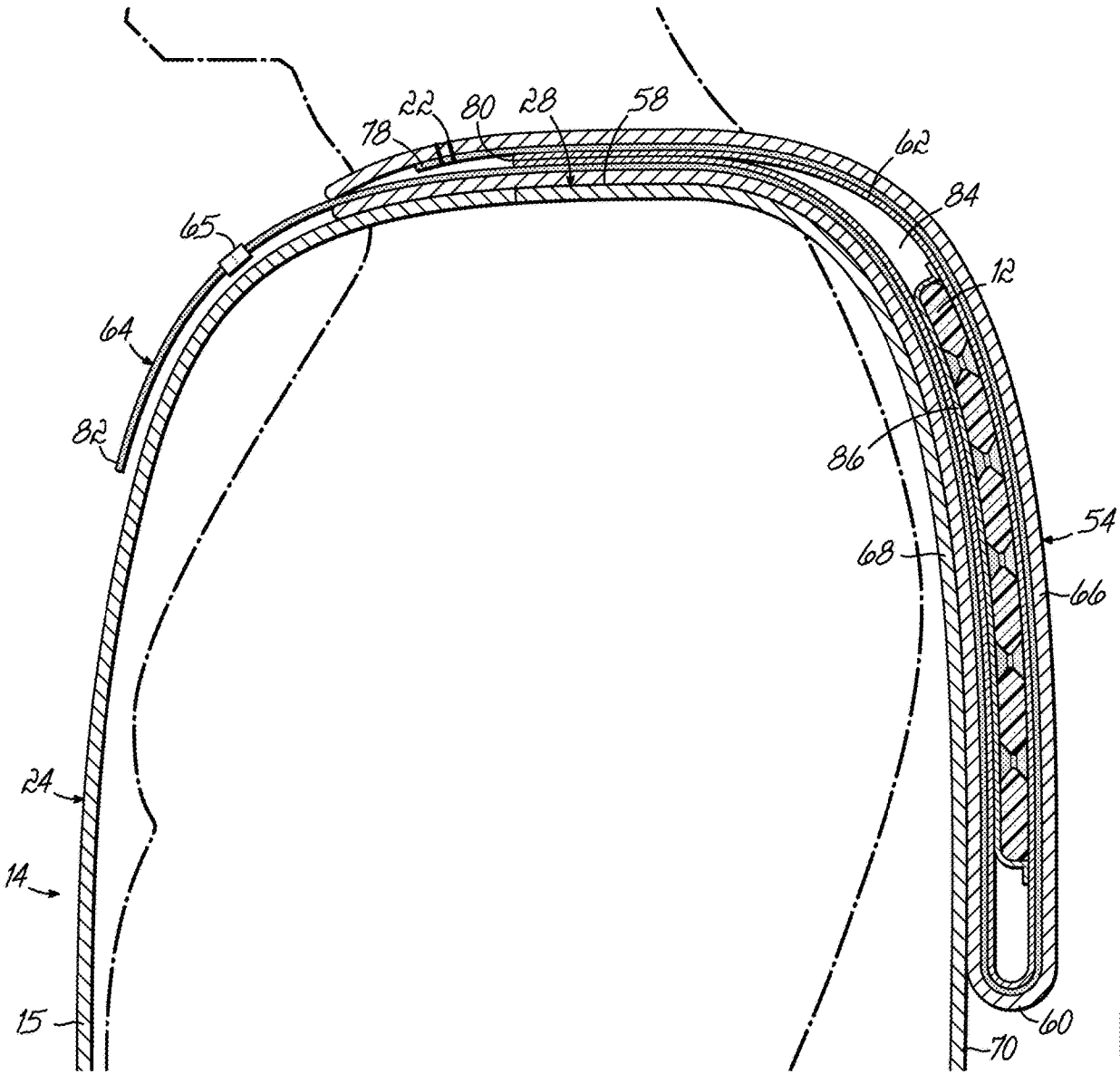
FIG. 9A is a partial cross-section of an alternative embodiment of the garment, showing the pillow housing and the pillow compartment and pillow pad contained therein in an uncompressed state.
Figure 10:
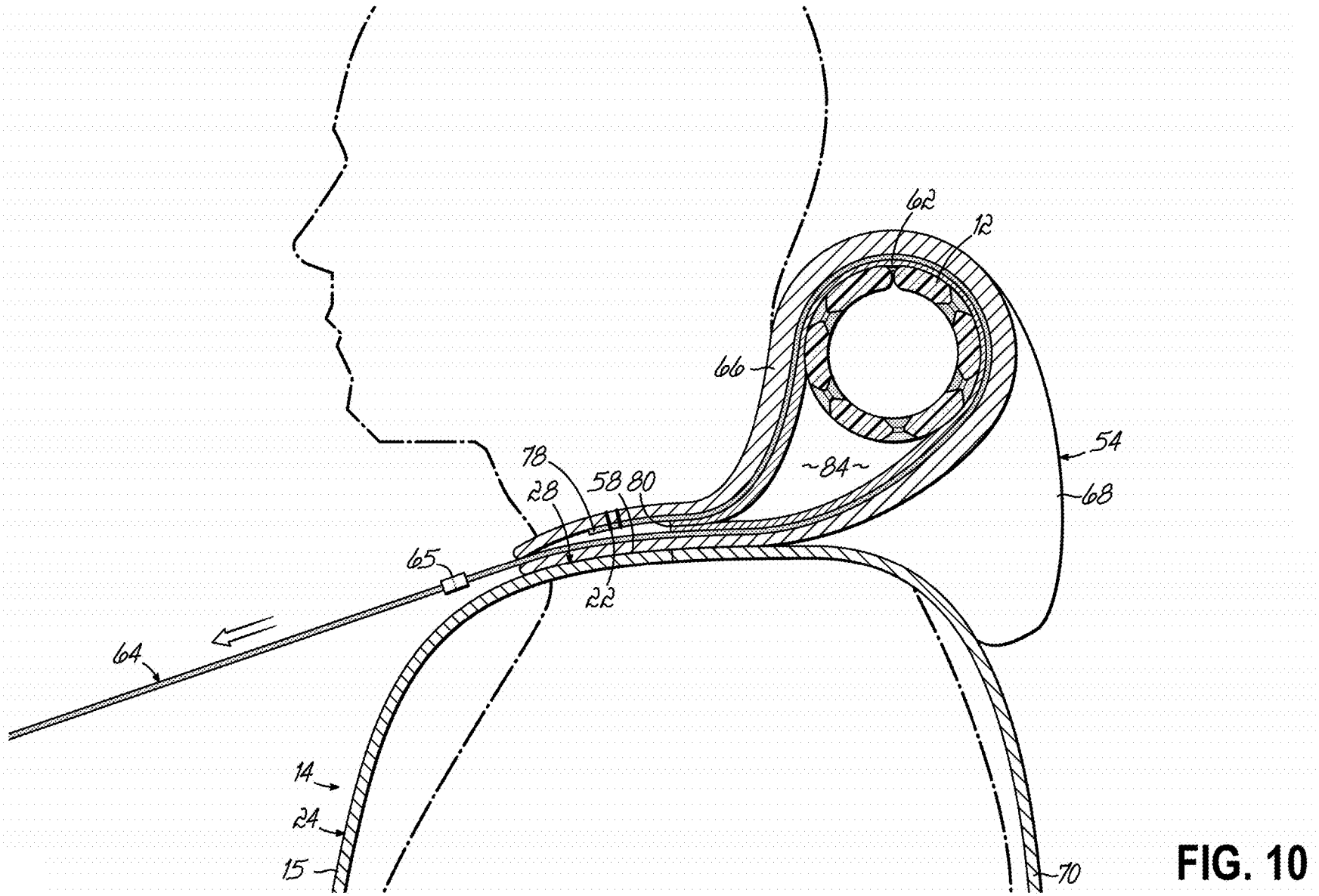
FIG. 10 is a is a partial cross-section of the garment of FIG. 1, showing the pillow housing and the pillow pad contained therein in a compressed state.

Referring now to FIGS. 9-10, the Figures show the pillow housing 54 (and thus the pillow pad 12 within the pillow housing 54) in an uncompressed (FIGS. 9 and 9A) and compressed (or actuated) state (FIG. 10). To create a cushion, a wearer pulls on the pillow housing drawstrings 64. Because the pillow housing drawstrings 64 are located in housing channels 62 that encircle the pillow pad 12 (as described above with respect to FIGS. 3-6), pulling on the pillow housing drawstrings 64 causes the pillow housing 54 and the pillow pad 12 therein to compress or roll upon itself. The pillow pad 12 may roll inside upon itself or outside upon itself. The lower end 60 of the pillow housing 54 is concurrently forced by the shortening of the portion of the pillow housing drawstrings 64 in the housing channels 62 to move upwardly near to or in contact with the upper end 58 of the pillow housing 54. In other words, the lower end 60 of the pillow housing 54 is moved from its uncompressed, unactuated (e.g., default) state at a location approximately midback of a wearer to a compressed, actuated state at a location at or near the shoulder and/or neck region 26, 28 of the garment 10 by pulling the pillow housing drawstrings 64. In so doing, the pillow housing 54 and pillow pad 12 are reshaped to form a cushion, specifically a rounded neck pillow, that a wearer can rest his or her neck or head against. The cushion is configured to provide support for a wearer's neck and head. The pillow housing 54 and pillow pad 12 may optionally be secured in the compressed, actuated state by use of drawstring fasteners 65. For example, cord locks (or similar) located on the pillow housing drawstrings 64 could secure the pillow housing 54 and pillow pad 12 in the compressed, actuated state. Such may be desirable if a wearer foresees maintaining the pillow pad 12 in the cushion state for an extended period of time.

Further, the Figures show an interface between the pillow housing 54 and the garment 10 at the shoulder region 26 of the garment 10. As shown, an end 78 of the pillow housing drawstring 64 is secured to the garment 10 (e.g., by stitching 22). The pillow housing drawstring 64 then extends through the housing channel 62 and reemerges through an opening 80 at or near the location where the end 78 of the pillow housing drawstring 64 is secured to the garment 10. The opposing (free) end 82 of the pillow housing drawstring 64 may be pulled by a wearer to create a neck/head cushion, as described above. When not in use, opposing ends 82 of the pillow housing drawstrings 64 may rest against the garment body 14 of the garment 10. To this end, one set of drawstrings 42 may be used to operate the hood 18, while another (distinct) set of drawstrings 64 may used to operate the pillow pad 12, and the sets of drawstrings 42, 64 may be differentiated by different coloring or materials to assist a wearer.

Referring specifically to FIG. 9A, the Figure shows an alternate interior 84 of the pillow housing 54. Specifically, the embodiment depicted in FIG. 9A includes a pillow compartment 86 defined within the interior 84 of the pillow housing 54. In the depicted embodiment, the pillow compartment 86 includes webbing that secures the pillow pad 12 within the pillow housing 54. In alternative embodiments, it is to be understood that the pillow pad 12 could be removably secured within the pillow housing 54 in an alternative fashion. For example, the pillow pad 12 could be removably secured within the pillow housing 54 by hook-and-loop fasteners, snap fasteners, buttons, or similar. Additionally, a cover (as described above) may be added to serve as a further safeguard, in addition to the pillow compartment 86, to prevent the pillow pad 12 from accidentally falling out of the pillow housing 54.

Figure 11:
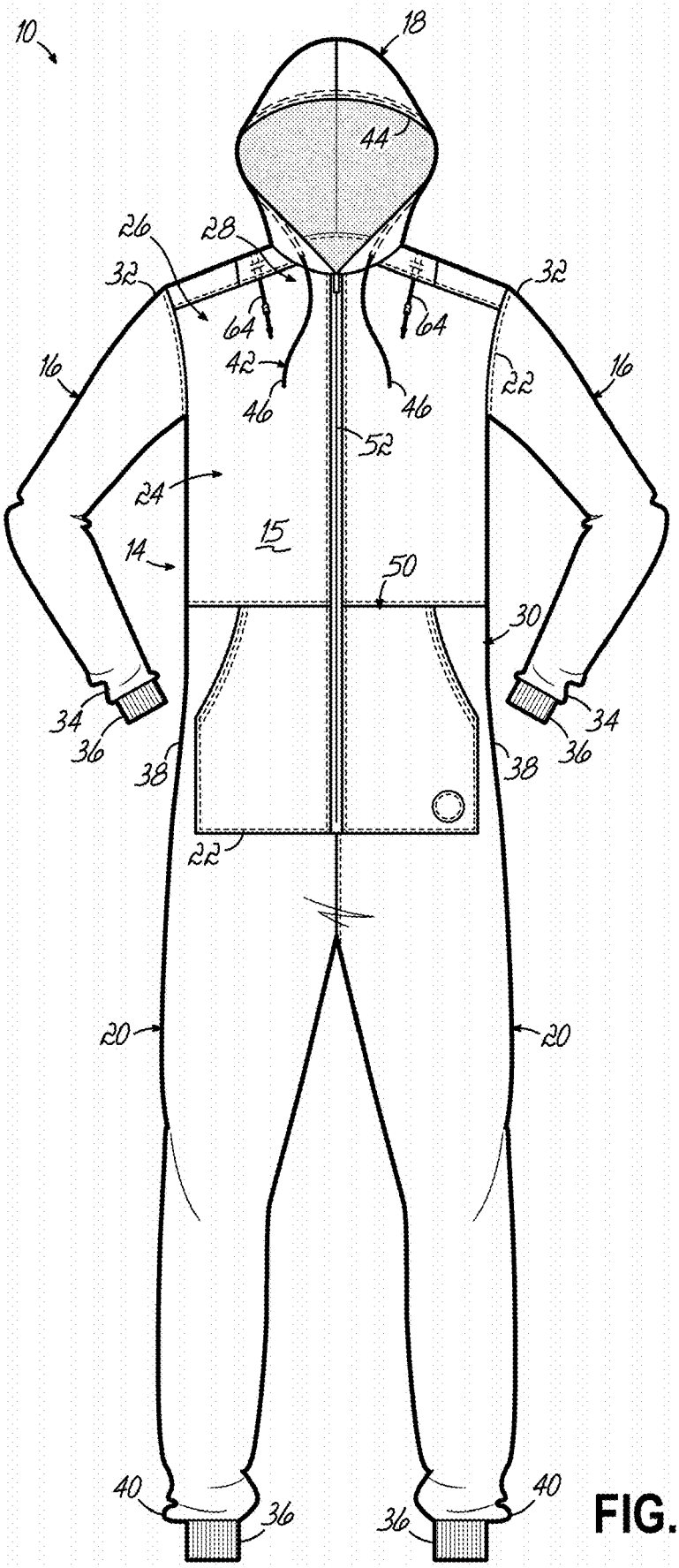
FIG. 11 is a front view of an alternative embodiment of the garment.
Figure 12:
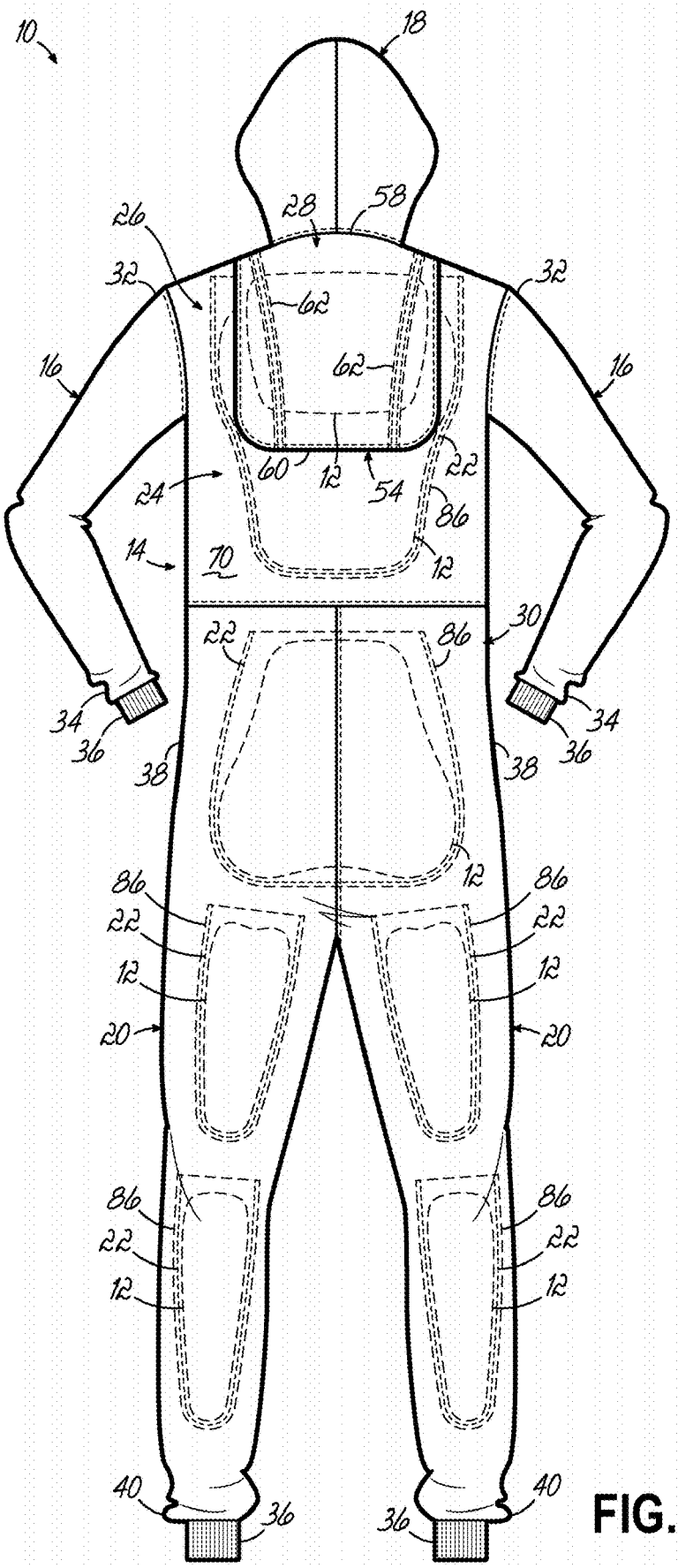
FIG. 12 is a rear view of the garment of FIG. 11.
Figure 13:
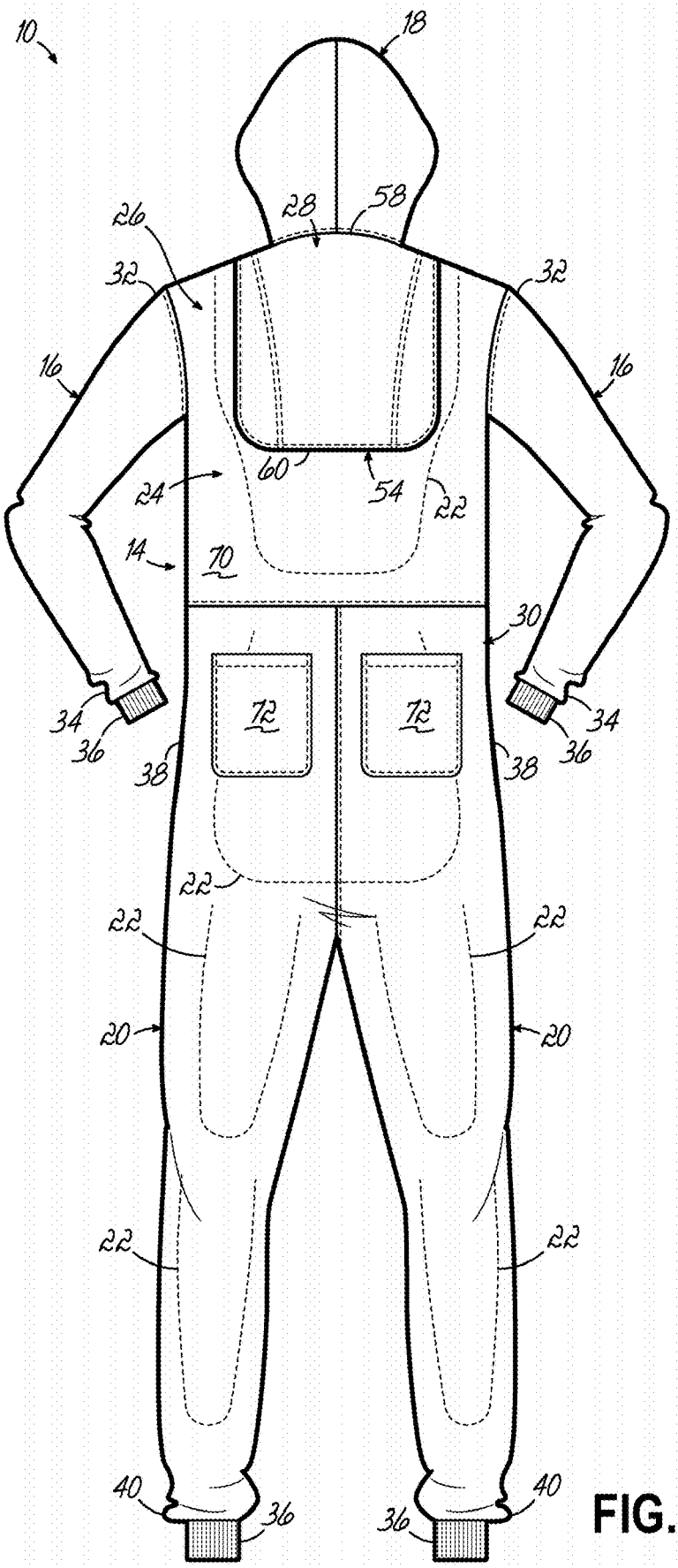
FIG. 13 is a rear view of a further alternative embodiment of the garment.

Referring now to FIGS. 11-13, the Figures depict an alternate embodiment of the garment 10. Particularly, the garment 10 embodiment depicted in FIGS. 11-13 is that of a "onesie" (as opposed to the "hoodie" embodiment of FIGS. 1 and 2, for example). As mentioned briefly above, the garment 10 embodiment in FIGS. 11-13 includes pant legs 20. Each pant leg 20 is attached to the garment body 14 at or near the waist region 30. A proximal end 38 of the pant leg 20 attaches at or near the waist region 30 by stitching 22, for example. The pant leg 20 extends away from the waist region 30 of the garment body 14 and terminates at a distal end 40. Like the arm sleeves 16, each of the pant legs 20 includes a cuff 36 at a distal end 40 of the pant legs 20. It is to be understood that alternative embodiments of the garment 10 may or may not include cuffs 36 at the end of pant legs 20. Further, it is to be understood that the pant legs 20 do not necessarily have to span the length of a wearer's legs (e.g., be pant length, as depicted). The pant legs 20 of various embodiments of the garment 10 may be shorter in length—for example, shorts length or capri length. As noted above, a preferred embodiment of the garment 10 may not include pant legs 20 (see FIGS. 1 and 2). However, alternative embodiments of the garment 10 (e.g., the front and back panels 15, 70) will at least enclose a wearer at least along a shoulder region 26, a torso region 24, and a waist region 30. Moreover, as shown in FIG. 13, for example, the garment 10 may include rear pockets 72 on the rear of the garment 10. Such rear pockets 72 may be in addition to front pocket 50 (as shown in FIG. 11, for example) or, in an alternative embodiment, in lieu of a front pocket 50.

Referring specifically to FIG. 12, the Figure shows a number of additional pillow compartments 86 attached to the pant legs 20 (e.g., by stitching 22) and located within an interior of the garment body 14. In the depicted embodiment, each pant leg 20 features two additional pillow compartments 86 located roughly at the thigh and calf areas of a wearer's body. A further additional pillow compartment 86 is located roughly at a wearer's posterior region. The construction of these additional pillow compartments 86 is similar to the pillow compartment 86 described above with reference to FIG. 9A. Additional pillows 12 are located within the additional pillow compartments 86. The pillows 12 may be similar to the pillow 12 of the pillow housing 54, embodiments of which are described below with reference to FIGS. 14-17. These additional pillow compartments 86 (and additional pillows 12 therein) provide further comfort for a wearer. Particularly, the additional pillows 12 within the additional pillow compartments 86 provide additional support and cushion for a wearer's legs and posterior.

Referring now to FIGS. 14-17, the Figures show embodiments of a pillow pad 12 that could be inserted into the pillow housing 54 or into the pillow compartments 86 of the back panel 70 or pant legs 20. The pillow pad 12 is preferably formed of memory foam or a similar material. FIGS. 14 and 15 show one embodiment of a pillow pad 12. FIGS. 16 and 17 show an alternative embodiment of a pillow pad 12.

The pillow pad 12 of FIGS. 14 and 15 is roughly rectangular (e.g., rectilinear) in shape and has curved edges. The rectangular shape of the pillow pad 12 allows for the pillow pad 12 to be compressed or rolled onto itself to form a neck cushion. The curved edges of the pillow pad 12 reduce the effort necessary to insert the pillow pad 12 into the pillow housing 54. The pillow pad 12, in an embodiment, may be approximately 14 inches in length, 11 inches in height, and 0.5 inches in width. However, it is to be understood that the dimensions of the pillow pad 12 will vary in different embodiments and, particularly, will vary according to the size of the pillow housing 54 that the pillow pad 12 is to be inserted into. As shown in the embodiment depicted in FIG. 14, the pillow pad 12 tapers in dimension from the top of the pillow pad 12 to the bottom of the pillow pad 12. Specifically, the top of the pillow pad 12 is slightly wider than the bottom of the pillow pad 12. The pillow pad 12 is widest at a location near to the top of the pillow pad 12. Like the curved edges, the tapered shape of the pillow pad 12 reduces the effort necessary to insert the pillow pad 12 into the pillow housing 54.

Further, the pillow pad 12 of FIGS. 14 and 15 includes a series of regular repeating apertures 88 (e.g., compression features) arranged in a pattern. In the depicted embodiment, the openings of the apertures 88 at a surface of the pillow pad 12 are circular in shape (see FIG. 14). In profile, the apertures 88 taper from the openings at the front and back surfaces of the pillow pad 12 to a narrow, central portion of the aperture 88 (see FIG. 15), thereby defining an hourglass-shaped profile in cross-section. The shape of the apertures 88 depicted in FIGS. 14 and 15 achieve a balance between flexibility and airflow. The apertures 88 span the width of the pillow pad 12. The apertures 88 provide for greater flexibility of the pillow pad 12 (e.g., when transitioning to and from a compressed, actuated state, for example) and, further, allow for air to pass through the pillow pad 12 to prevent the pillow pad 12 from becoming too hot during use (e.g., when used as a neck/head cushion).

Like the pillow pad 12 of FIGS. 14 and 15, the pillow pad 12 of FIGS. 16 and 17 is roughly rectangular (e.g., rectilinear) in shape and has curved edges. The rectangular shape of the pillow pad 12 allows for the pillow pad 12 to be compressed or rolled onto itself to form a neck cushion. The curved edges of the pillow pad 12 reduce the effort necessary to insert the pillow pad 12 into the pillow housing 54. The pillow pad 12, in an embodiment, may be approximately 14 inches in length, 11 inches in height, and 1 inch in width. However, it is to be understood that the dimensions of the pillow pad 12 will vary in different embodiments and, particularly, will vary according to the size of the pillow housing 54 that the pillow pad 12 is to be inserted into. Like the pillow pad 12 of FIG. 14, the pillow pad 12 of FIG. 16 tapers in dimension from the top of the pillow pad 12 to the bottom of the pillow pad 12. Specifically, the top of the pillow pad 12 is slightly wider than the bottom of the pillow pad 12. The pillow pad 12 is widest at a location near to the top of the pillow pad 12. Like the curved edges, the tapered shape of the pillow pad 12 reduces the effort necessary to insert the pillow pad 12 into the pillow housing 54.

Further, the pillow pad 12 of FIGS. 16 and 17 includes a series of regular repeating apertures 88 arranged in a pattern. In the depicted embodiment, the openings of the apertures 88 at a surface of the pillow pad 12 are circular in shape (see FIG. 16). Unlike the apertures 88 of FIGS. 14 and 15, the apertures 88 of FIGS. 16 and 17 do not taper or otherwise vary in dimension between the front and back surfaces of the pillow pad 12 (see FIG. 17). Such tapering is unnecessary due to the addition of the grooves 90 in this embodiment of the pillow pad 12. The apertures 88 span the width of the pillow pad 12.

However, the alternative embodiment of the pillow pad 12 (shown in FIGS. 16 and 17) further includes a number of grooves 90 (e.g., compression features). In the depicted embodiment, the grooves 90 are formed on both the front and back surfaces of the pillow pad 12, are spaced vertically from each other, and extend horizontally from one edge of the pillow pad 12 to the opposing edge of the pillow pad 12. The grooves 90 help to facilitate the compression of the pillow pad 12 when the pillow housing 54 and pillow pad 12 are actuated by the pillow housing drawstrings 64. In profile, the grooves 90 are roughly U-shaped in the depicted embodiment. However, it is to be understood that the grooves 90 could be differently shaped—V-shaped, for example.

The pillow pad 12 of FIGS. 16 and 17 is thicker than the one shown in FIGS. 16 and 17, and the combination of the apertures 88 and the grooves 90 advantageously allows for the desirable actuation functionality as described above (for adding comfort to the wearer) while also providing a larger size of the resulting cushion or neck pillow. It is to be understood that further alternative embodiments of a pillow pad 12 could be inserted into the pillow housing 54 and used with the garment 10.

While the present invention has been illustrated by the description of various embodiments and while these embodiments have been described in some detail, it is not the intention of the Applicant to restrict or in any way limit the scope of the invention to such detail. Additional advantages and modifications will readily appear to those skilled in the art. The invention in its broader aspects is therefore not limited to the specific details and illustrative examples shown and described. Accordingly, departures may be made from such details without departing from the scope of the general inventive concept.

What is claimed is:

1. A garment for selectively providing comfort features for a wearer of the garment, the garment comprising:

a garment body including a front panel and a back panel, the front panel and the back panel connected to each other and configured to enclose a torso of the wearer;

a pillow housing, a proximal end of the pillow housing secured to the garment body at a shoulder region of the garment body, the pillow housing enclosing a pillow pad within the pillow housing, the pillow housing being convertible between an uncompressed state and a compressed state; and a drawstring assembly including at least one drawstring, the at least one drawstring fixed at an end to the garment body at the shoulder region, the at least one drawstring continuously extends from the shoulder region along one side of the pillow housing towards a distal end of the pillow housing, then wraps along the distal end of the pillow housing, then extends along another side of the pillow housing towards the proximal end of the pillow housing, and returns to the shoulder region, wherein the garment is configured such that when a pull force is exerted on a free end of the at least one drawstring, the pillow housing is converted from the uncompressed state to the compressed state, the pillow housing and pillow pad in the compressed state forming a cushion at a neck region of the garment adjacent the shoulder region and configured to provide support for the wearer's neck and head.

2. The garment of claim 1, wherein the pillow housing further includes at least one housing channel extending along a surface of the pillow housing, the at least one drawstring extending through the at least one housing channel, the at least one housing channel preventing the at least one drawstring from directly contacting the pillow pad within the pillow housing.

3. The garment of claim 1, wherein the pillow housing further includes a pillow compartment, the pillow compartment configured to further secure the pillow pad within the pillow housing.

4. The garment of claim 1, wherein the pillow housing further includes a closure zipper for securing the pillow pad within the pillow housing, the closure zipper located on a lateral side of the pillow housing.

5. The garment of claim 1, wherein the back panel of the garment body further includes a back cushion configured to provide support for the wearer's back, the back cushion removably secured to the back panel by a pillow compartment.

6. The garment of claim 1, wherein the garment body further includes at least one arm sleeve, the at least one arm sleeve connected at a proximal end to the garment body adjacent the shoulder region, the at least one arm sleeve including a cuff at a distal end of the at least one arm sleeve, the distal end of the at least one arm sleeve opposite the proximal end of the at least one arm sleeve.

7. The garment of claim 1, wherein the garment body further includes a hood connected to the garment body at the shoulder region.

8. The garment of claim 1, wherein the garment body further includes a front pocket located on the front panel of the garment body.

9. The garment of claim 8, wherein the front pocket is located near a waist region of the garment body.

10. The garment of claim 1, wherein the garment body further includes a waist cuff at a waist region of the garment body.

11. The garment of claim 1, wherein the front panel of the garment body further includes a closure zipper, the closure zipper extending substantially vertically from the neck region to a waist region of the garment body.

12. The garment of claim 1, wherein the garment body further includes at least one pant leg, the at least one pant leg connected at a proximal end to the garment body adjacent a waist region, the at least one pant leg including a cuff at a distal end of the at least one pant leg, the distal end of the at least one pant leg opposite the proximal end of the at least one pant leg.

13. The garment of claim 12, wherein the at least one pant leg includes at least one leg cushion, the at least one leg cushion removably secured to the at least one pant leg by a pillow compartment.

14. The garment of claim 13, wherein the at least one leg cushion includes a first leg cushion and a second leg cushion, the first leg cushion located adjacent the waist region and configured to provide support for the wearer's posterior and the second leg cushion located between the first leg cushion and the distal end of the at least one pant leg and configured to provide support for the wearer's leg, the distal end of the at least one pant leg opposite the proximal end of the at least one pant leg.

15. The garment of claim 1, wherein the pillow pad includes compression features configured to facilitate a compression of the pillow pad when the pillow housing and pillow pad convert from the uncompressed state to the compressed state, and wherein the compression features are defined by apertures.

16. The garment of claim 1, wherein the pillow pad extends continuously across a central portion of the pillow housing within the pillow housing.

17. The garment of claim 16, wherein the pillow housing includes a distal end opposite the proximal end, the distal end of the pillow housing being not directly secured to the garment body, and wherein in the uncompressed state, the distal end of the pillow housing extends and terminates approximately halfway down the back panel of the garment body, and wherein a lower end of the back panel at least partially defines a lowermost end of the garment body.

18. A garment for selectively providing comfort features for a wearer of the garment, the garment comprising:

a garment body including a front panel and a back panel, the front panel and the back panel connected to each other and configured to enclose a torso of the wearer;

a pillow housing, a proximal end of the pillow housing secured to the garment body at a shoulder region of the garment body, the pillow housing enclosing a pillow pad within the pillow housing, the pillow housing being convertible between an uncompressed state and a compressed state; and a drawstring assembly including at least one drawstring, the at least one drawstring extending around the pillow housing and fixed at an end to the garment body at the shoulder region, wherein the garment is configured such that when a pull force is exerted on a free end of the at least one drawstring, the pillow housing is converted from the uncompressed state to the compressed state, the pillow housing and pillow pad in the compressed state forming a cushion at a neck region of the garment adjacent the shoulder region and configured to provide support for the wearer's neck and head, and wherein the pillow housing includes a distal end opposite the proximal end, the distal end of the pillow housing being not directly secured to the garment body, and wherein in the uncompressed state the distal end of the pillow housing extends and terminates approximately halfway down the back panel of the garment body, and wherein a lower end of the back panel at least partially defines a lowermost end of the garment body.

19. The garment of claim 18, wherein the pillow pad extends continuously across a central portion of the pillow housing within the pillow housing.

20. A garment for selectively providing comfort features for a wearer of the garment, the garment comprising:

a garment body configured to enclose a torso of the wearer, the garment body including two arm sleeves and a hood connected to the garment body;

a pillow housing secured to the garment body, the pillow housing enclosing a pillow pad within the pillow housing, the pillow pad extending continuously across a central portion of the pillow housing within the pillow housing, the pillow housing including a closure zipper for securing the pillow pad within the pillow housing, the pillow housing including at least one housing channel extending along a surface of the pillow housing, the pillow housing being convertible between an uncompressed state and a compressed state; and a drawstring assembly including at least one drawstring, the at least one drawstring extending through the at least one housing channel, the at least one housing channel preventing the at least one drawstring from directly contacting the pillow pad within the pillow housing, wherein the garment is configured such that when a pull force is exerted on a free end of the at least one drawstring, the pillow housing is converted from the uncompressed state to the compressed state, wherein the pillow housing and pillow pad in the compressed state form a cushion.

* * * * *